United States Patent [19]

Minami

[11] Patent Number: 4,537,248

[45] Date of Patent: Aug. 27, 1985

[54] AIR-COOLED HEAT EXCHANGER

[75] Inventor: Kunihiko Minami, Sakai, Japan

[73] Assignee: Sasakura Engineering Co., Ltd., Osaka, Japan

[21] Appl. No.: 497,863

[22] Filed: May 25, 1983

Related U.S. Application Data

[62] Division of Ser. No. 214,086, Dec. 8, 1980, Pat. No. 4,417,619.

[51] Int. Cl.[3] ..... F28B 1/06; F28B 9/10

[52] U.S. Cl. ..... 165/113; 165/114; 165/172; 165/DIG. 1; 165/DIG. 13; 165/DIG. 24

[58] Field of Search ..... 165/113, 114, 124, 126, 165/134, 172, DIG. 1, DIG. 13, DIG. 24

[56] References Cited

U.S. PATENT DOCUMENTS

| | | | |
|---|---|---|---|
| 2,217,410 | 10/1940 | Howard | 165/114 |
| 2,301,433 | 11/1942 | McElgin | 165/172 |
| 2,587,720 | 3/1952 | Fritzberg | 165/172 |
| 2,640,687 | 6/1953 | Throckmorton | 165/172 |
| 2,806,674 | 9/1957 | Biehn | 165/172 |
| 2,893,509 | 7/1959 | Baird | 165/134 R |
| 3,112,793 | 12/1963 | Sass | 165/172 |
| 3,142,970 | 8/1964 | Hale | 165/172 |
| 3,223,152 | 12/1965 | Schulenberg | 165/172 |
| 3,534,806 | 10/1970 | Rodgers | 165/1 |
| 3,543,843 | 12/1970 | Gunter | 165/113 |
| 3,705,621 | 12/1972 | Schoonman | 165/112 |
| 3,887,002 | 6/1975 | Schoonman | 165/113 |
| 3,968,836 | 7/1976 | Larinoff | 165/134 R |
| 4,168,742 | 9/1979 | Kluppel et al. | 165/114 |
| 4,208,988 | 6/1980 | Jacobs et al. | 165/172 X |

FOREIGN PATENT DOCUMENTS

| | | | |
|---|---|---|---|
| 50-12771 | 4/1975 | Japan . | |
| 51-25259 | 2/1976 | Japan . | |
| 52-50057 | 11/1977 | Japan . | |
| 53-26856 | 8/1978 | Japan . | |
| 54-158750 | 12/1979 | Japan | 165/114 |
| 55-99583 | 7/1980 | Japan | 165/114 |
| 55-99584 | 7/1980 | Japan | 165/111 |
| 143428 | 5/1920 | United Kingdom | 165/113 |
| 900407 | 7/1962 | United Kingdom | 165/114 |

*Primary Examiner*—Sheldon J. Richter

*Attorney, Agent, or Firm*—Marshall O'Toole Gerstein, Murray & Bicknell

[57] ABSTRACT

This disclosure relates to an aircooled heat exchanger including first and second sets of tubes that carry a fluid to be cooled. One end of each tube is connected to an inlet header and the other end is connected to an outlet header. Each tube includes first and second longitudinal portions which are joined or connected by an intermediate bent portion. The tubes are arranged in the flow path of a cooling air flow. The first portions of the first set of tubes are located upstream, with respect to the direction of air flow, relative to the second portions of the first set and relative to the first portions of the second set, and the second portions of the second set are located upstream relative to the first portions of the second set and to the second portions of the first set. This offset relation of portions of the tubes substantially equalizes the heat exchange with the air.

2 Claims, 12 Drawing Figures

AIR-COOLED HEAT EXCHANGER

This is a division of patent application Ser. No. 214,086, filed on Dec. 8, 1980 now U.S. Pat. No. 4,417,619, issued Nov. 29, 1983.

DETAILED DESCRIPTION

The heat-transfer tubes of air-cooled heat exchangers are generally of the finned type and are arranged in a plurality of planes. High-temperature vapor flows through the tubes and is cooled by air blown across the tubes. The air, in turn, is heated by heat exchange with the vapor as the air flows across the planes of tubes. As a result, the tubes of the planes upstream with respect to the air flow are cooled more than those in the downstream planes. The air temperature difference between the farthest upstream planes and the farthest downstream planes is relatively great since there are no particular limits to the increase of the cooling air temperature, whereas, in water-cooled heat exchangers, the cooling water temperature increase should be limited in order to avoid scale.

If the fluid flowing through the tubes of an air-cooled heat exchanger is a gas or a liquid which does not change its phase, the fluid in each of the planes of tubes is mixed with that of the other planes of tubes at the outlets thereof, resulting in effective cooling of the fluid.

However, if the fluid is a condensible gas or vapor which can change its phase, the heat transfer differs among the planes of the tubes. Specifically, in the tubes of a plane that is downstream with respect to the air flow, the heat transfer decreases, thus reducing the amount of condensed vapor, whereas in the tubes of an upstream plane, although the amount of vapor flowing thereinto increases with the amount of condensation of the vapor therewithin, the amount of vapor flow decreases toward the outlet as the flow resistance increases within the tubes, so that the condensate is likely to be overcooled because of a smaller amount of vapor despite a sufficient area for heat transfer. Thus, the heat transfer area is not effectively used to condense vapor while, in the case of steam, the condensate may be overcooled and frozen within the parts of the tubes that are upstream with respect to the air flow, when the atmospheric temperature is below the freezing point in winter.

To overcome those problems, arrangements have been provided, for example, for varying the pitch of the cooling fins attached to the tubes, or for using tubes partially devoid of fins (see U.S. Pat. No. 3,543,843), or for varying the number or the diameters of the fins (U.S. Pat. No. 3,223,152). Even if, however, the amount of air flow is adjusted, the balance of fluid pressure within the tubes is disturbed whenever the atmospheric temperature changes, and overcooling may occur.

To protect against such overcooling, means may be provided, for example, for forming each heat-transfer tube of a tube bundle as an individual closed circuit, and by removing the drain liquid or condensate from each tube (U.S. Pat. No. 3,968,836), or for providing a plurality of U-shaped tubes inside and outside of a vapor inlet header in consideration of a difference of internal pressure between the tubes (U.S. Pat. No. 3,705,621). The former arrangement has a complex construction, and in the latter arrangement, the tube pitch may be limited and the drain liquid tends to remain within the tubes when the apparatus stops operating, since the tubes are substantially horizontal.

It is a general object of this invention to provide an air-cooled heat exchanger having a plurality of planes of heat-transfer tubes, wherein the vapor pressure of the fluid being cooled within the tubes by heat exchange with air, is substantially equalized between the planes of the tubes, and the condensate is removed quickly, in order to prevent the condensate from freezing and to improve the efficiency of heat transfer.

An air-cooled heat exchanger according to this invention comprises first and second sets of finned tubes extending generally in parallel to each other, through which a fluid being cooled flows in the same direction and across which air is blown to cool the fluid within said tubes, said first set of tubes having a first longitudinal portion and a second longitudinal portion downstream of said first portion with respect to the air flow, and said second set of tubes having a first longitudinal portion adjacent to and downstream with respect to the air flow of said first portion of said first set of tubes and a second longitudinal portion adjacent to said second portion of said first set of tubes and upstream with respect to the air flow of said first portion of said second set of tubes and also upstream of said second portion of said first set of tubes, said first and second portions of each tube being connected by an intermediate bend.

Preferred embodiments of this invention will be better understood from the following description taken in conjunction with the accompanying drawings. The invention is not restricted to the following described embodiments and the invention is to be limited only by the scope of the annexed claims. In the drawings:

Figure 1:
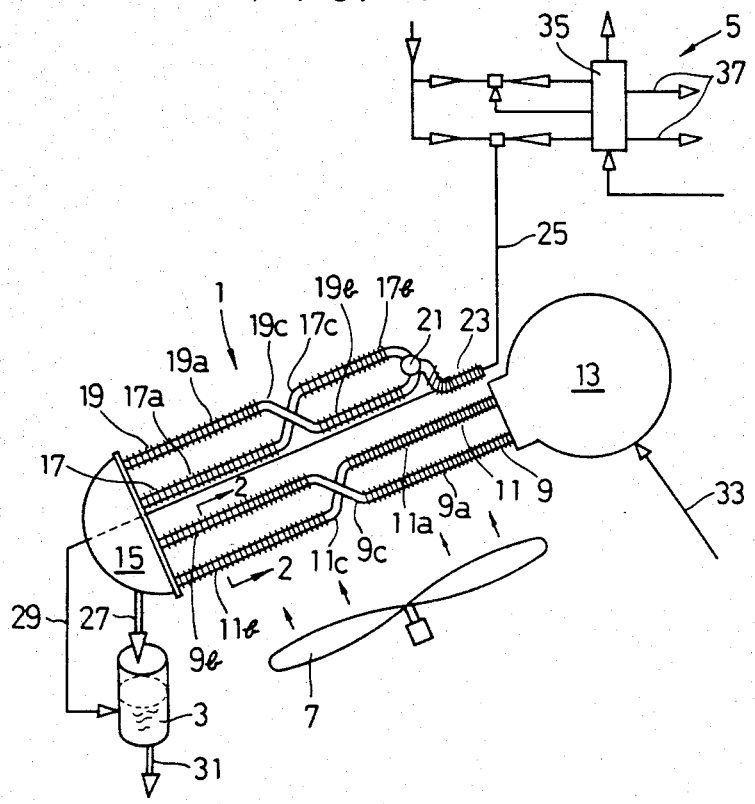
FIG. 1 is a schematic view of apparatus according to a first embodiment of the invention.
Figure 2:
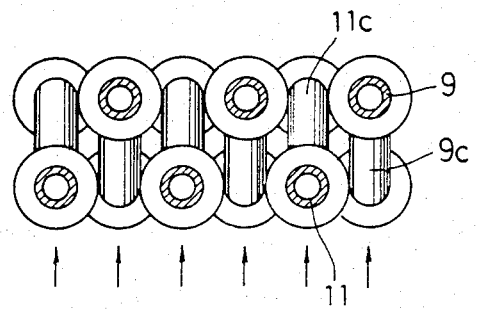
FIG. 2 is an enlarged sectional view taken on the line 2—2 of FIG. 1, across tubes of the apparatus shown in FIG. 1.

Referring to FIGS. 1 and 2, an air-cooled heat exchanger comprises a bundle 1 of heat transfer tubes, a condensate well 3, a gas extractor 5, and a cooling air circulating fan 7 provided below the tube bundle for moving air across the tubes to cool and thereby condense fluid flowing through the tubes, such as turbine exhaust vapor or other fluid having a relatively high freezing point.

The tube bundle 1 includes a plurality of pairs of main cooling tubes 9 and 11 extending in two planes between a generally horizontal inlet header 13 and a outlet header 15 which is generally parallel to but at a level lower than the inlet header. Vapor flows through both tubes 9 and 11 in the same direction from the inlet header 13 to the outlet header 15.

One tube 9 of each pair has a longitudinal finned portion 9*a* extending from adjacent the inlet header 13 in a plane that is upstream with respect to the air flow from the fan 7, and another longitudinal finned portion 9*b* extending from adjacent the outlet header 15, the portion 9*b* being downstream with respect to the air flow. The other tube 11 of the pair has a longitudinal finned portion 11*a* extending from adjacent the inlet header 13 and being in a downstream plane with respect to the air flow and another longitudinal finned portion 11*b* extending from adjacent the outlet header 15 and being in an upstream plane with respect to the air flow.

The longitudinal portions 9*a* and 11*a* are connected respectively to the opposite portions 9*b* and 11*b* by cross-over portions or bends 9*c* and 11*c*, which are not finned so as to facilitate the interlaced piping or construction. If desired, air flow across the unfinned portions 9*c* and 11*c* may be avoided by providing suitable blocking plates (not shown) or the like.

Referring particularly to FIG. 2, the distance between two adjacent finned tubes should preferably be less than 1.75 times the diameter of the fins, so that each fin of one tube is partially superposed, when seen in cross section, between the fins of the next adjacent tube or tubes in order to increase the heat transfer area per amount of air flow. The fan 7 moves the cooling air upwardly, as seen in FIG. 2, through the tubes.

The tube bundle 1 further includes a plurality of pairs of secondary or auxiliary cooling tubes 17 and 19 extending from the outlet header 15 in two planes which are downstream with respect to the air flow from the main tubes 9 and 11. Each of the tubes 17 and 19 of each pair likewise has two longitudinal finned portions connected by an unfinned bend, one portion being upstream and the other portion being downstream, with respect to the air flow, of the opposite portion thereof and of the adjacent finned portion of the other tube.

The other ends of the tubes 17 and 19 are connected by a collecting pipe 21, which communicates with a finned tube 23 for cooling gas, the tube 23 communicating through a piping 25 with the gas extractor 5.

The condensate collector 3 communicates with the outlet header 15 through a pipe 27 and with the tube 23 through a pipe 29, and it has a drain 31 at its bottom.

For some types of fluid flowing through the tubes, the main cooling tubes 9 and 11 may be straight finned tubes without the bends 9*c*, 11*c*, only the auxiliary tubes 17 and 19 having bent cross-over portions. Otherwise, a common vapor inlet may be provided for the tubes 9, 11, 17 and 19 while the tubes 9 and 11 are crossed and the tubes 17 and 19 are crossed by each other, with separate drains and separate gas extractors. The finned tube 23 may extend across either a partial air flow area, as shown in FIG. 1, or the entire area of air flow of the fan. The bundle of finned tubes may extend at a suitable angle to a horizontal plane, with the outlet header 15 being lower than the inlet header 13.

In the arrangement of FIG. 1, vapor exhausted from a turbine is supplied through a piping 33 to the inlet header 13 and then passed down through the tube portions 9*a* and 11*a* and cross-overs 9*c* and 11*c*, and through the tube portions 9*b* and 11*b* where the positions of vapor within the tubes are reversed with respect to the direction of cooling air flow, before flowing into the outlet header 15. The portion of the vapor condensed within the tubes by heat exchange with the cooling air is collected in the outlet header 15 and carried by the pipe 27 to the well 3, where it may be removed through the drain 31.

The uncondensed vapor remaining and the uncondensible gases are then passed likewise up through the auxiliary tubes 17 and 19 and are further cooled by passing through the tube 23. The non-condensible gases contain little vapor and are directed by the extractor 5 to flow through a condenser 35 before being discharged to the atmosphere through pipes 37. The extractor 5 may have a conventional construction.

The vapor and gases within the upstream portions 9*a*, 11*b*, 17*a* and 19*b* are cooled better than those within the downstream tube portions 11*a*, 9*b*, 19*a* and 17*b*, respectively. Because of the cross-overs 9*c*, 11*c*, 17*c* and 19*c*, however, the vapor or gas pressures within each main tube 9, 11 of each pair and within each auxiliary tube 17, 19 of each pair can be substantially equalized to that within the other tubes.

The condensate can be readily removed from the outlet header 15 without remaining within the tubes. This increases the heat transfer area of the tubes, and improves the thermal coefficiency.

Figure 3:
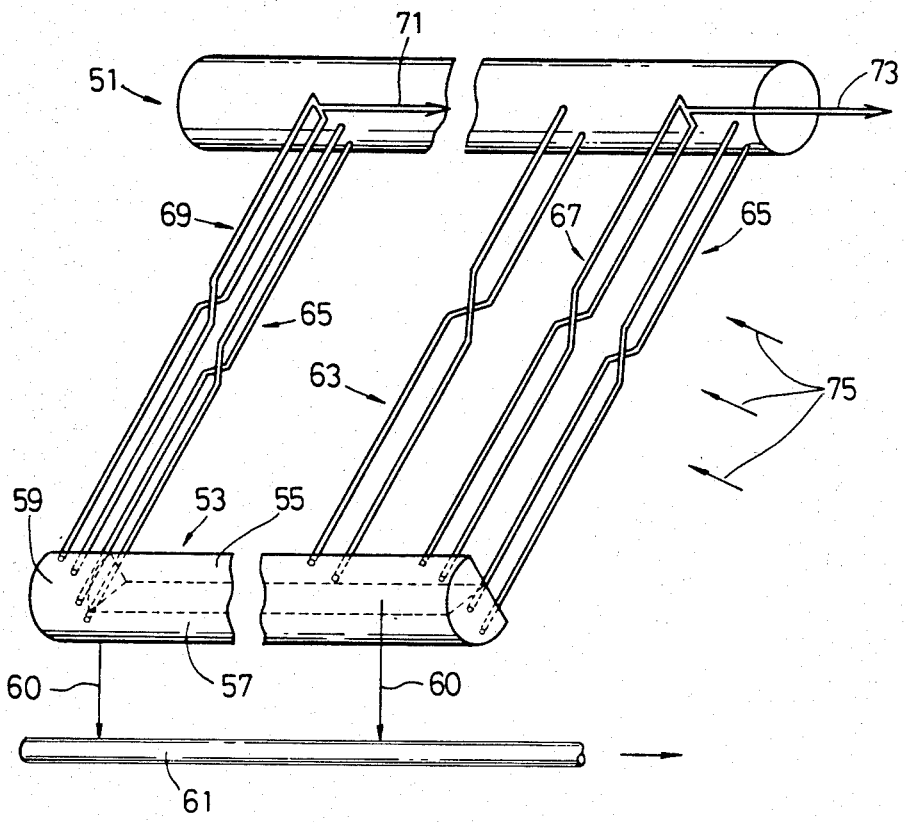
FIG. 3 is a schematic view of apparatus according to a second embodiment of the invention.

FIG. 3 diagrammatically shows the second embodiment, wherein the heat-transfer finned tubes are illustrated without their fins for simplification of the drawings. An inlet header 51 lies substantially horizontally and receives vapor exhausted, for example, from a turbine (not shown). An outlet header 53 lies generally parallel to and at a position lower than the inlet header 51, and it is divided into an upper chamber 55 and a lower chamber 57. However, the lower chamber 57 has an end portion 59 that is enlarged and extends across the header 53. The two chambers 55 and 57 are separated and are separately connected to a condensate pipe 61 by tubes 60.

A plurality of upper pairs 63 and a plurality of lower pairs 65 of main condenser tubes have the same finned structure and cross-over arrangement as the pairs of tubes 9 and 11 in FIG. 1. The upper pairs 63 extend between the inlet header 51 and the upper chamber 55 of the outlet header 53, while the lower pairs 65 extend between the inlet header 51 and the lower chamber of the outlet header, in parallel with the upper pairs.

Two pairs 67 and 69 of vent cooler tubes having a finned structure and cross-over arrangement the same as the pair of tubes 17 and 19 shown in FIG. 1, extend in parallel with the main pairs of tubes 63 and 65. One pair 67 is connected to the upper chamber 55 of the outlet header 53 while the other pair 69 extends from the end portion 59 of the lower chamber 57 at an upper level. The two pairs 67 and 69 communicate with gas extractors (not shown) by way of pipes 71 and 73, respectively.

Air is blown by a fan (not shown) from below or behind, the lower tubes 65 as indicated by arrows 75 and passes across all of the tubes. The vapor flows from the inlet header 51 through the main condenser tubes 63 and 65 where a major portion of the vapor condenses and drains to the outlet header 53, and the condensate is drained from the chambers 55 and 57 of the outlet header 53 by means of the condensate pipe 61. The remaining uncondensed vapor and gases flow through the chambers 55 and 57 and up into the pairs 67 and 69 of vent cooler tubes, respectively, where they are further cooled in order to minimize the remaining amount of vapor. The non-condensible gases with little vapor in them are directed to the gas extractors by way of the pipes 71 and 73, under different pressures.

Figure 4:
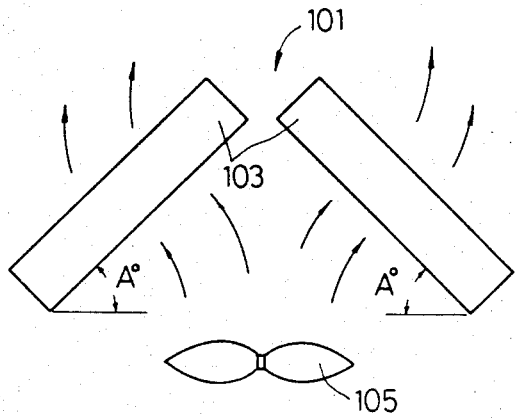
FIG. 4 is a schematic side view of apparatus according to a third embodiment of the invention.

Referring now to FIG. 4, an air-cooled heat exchanger 101 comprises a pair of condensers 103 arranged similarly to the opposite sides of a peaked roof and over an air fan 105 for cooling the condensers, each of the condensers being angled upwardly and toward the other at an angle A to a horizontal plane.

Figure 5:
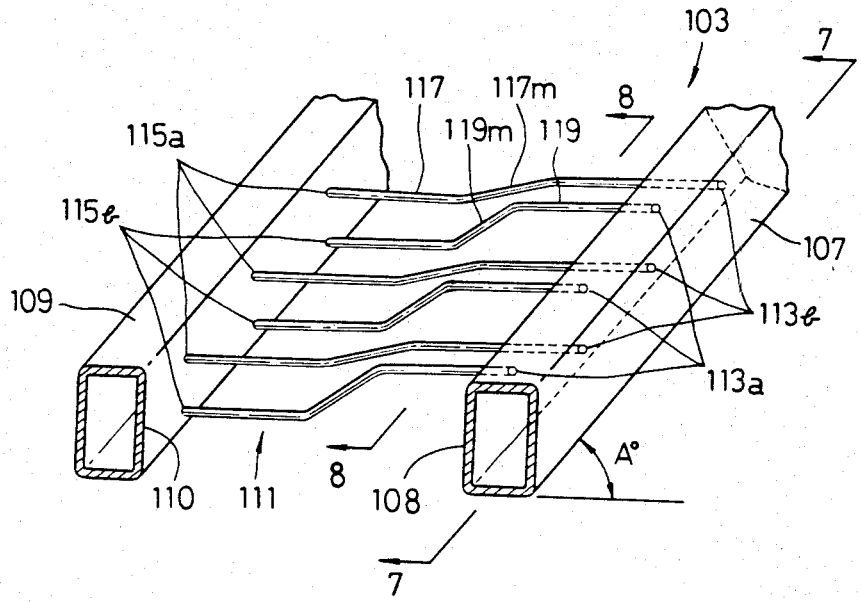
FIG. 5 is a fragmentary perspective view of the apparatus shown in FIG. 4.

As best shown in FIG. 5, each condenser 103 includes an inlet header 107, an outlet header 109 and a bundle of heat transfer tubes 111 that are provided with fins (not shown) similar to the fins of FIGS. 1 and 2, the tubes 111 extending generally horizontally between the headers. In this instance, the headers 107 and 109 are mounted at an angle of 45 degrees to the horizontal. Vapor, of course, flows through the tubes 111 from the inlet header 107 to the outlet header 109. The inlet header 107, and also the inlet header 51 shown in FIG. 3, receives vapor from a source. (not shown).

The wall 108 of the inlet header 107 which faces the outlet header has an upper row of holes 113*a* and a lower row of holes 113*b* formed through it. The wall 110 of the outlet header 109, which faces the inlet header, has an upper row of holes 115*a* and a lower row of holes 115*b* formed therethrough. The lower rows of holes 113*b* and 115*b* of both headers lie upstream of the upper rows 113*a* and 115*a*, with respect to the air flow from the fan 105.

Figure 7:
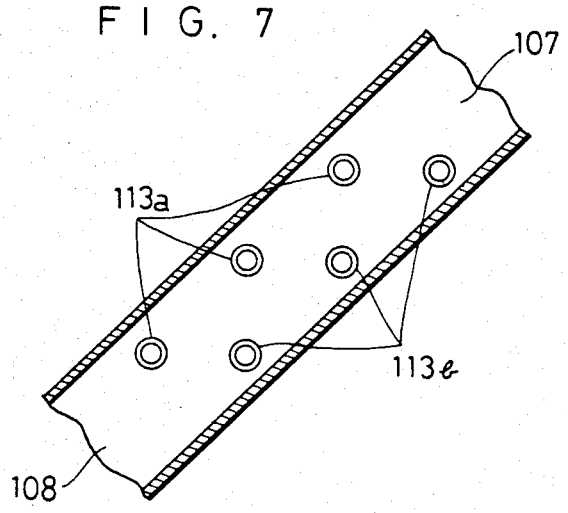
FIG. 7 is a sectional view taken on line 7—7 of FIG. 5.

As best shown in FIG. 7, the upper and lower rows of holes 113*a* and 113*b* of the inlet header are arranged in pairs. Each hole 113*b* is paired with a hole 113*a* that lies in the same horizontal plane, and further, each hole 113*b* is also paired with another hole 113*a* that lies in the same vertical plane.

Figure 6:
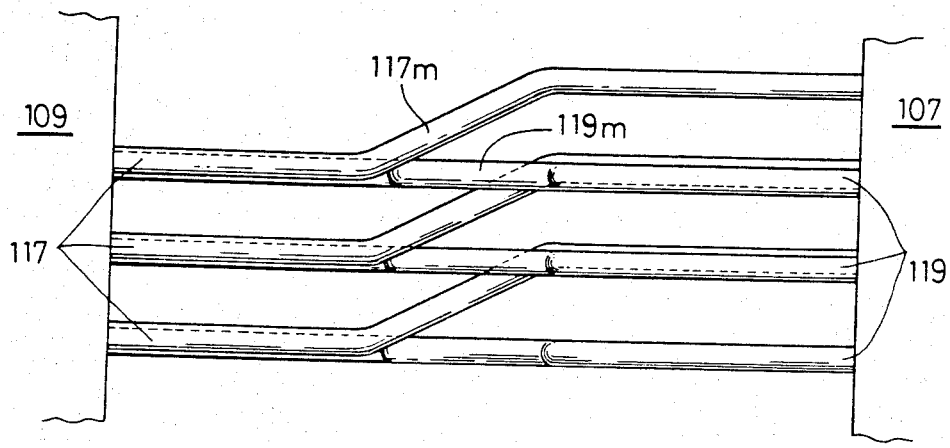
FIG. 6 is an enlarged fragmentary top plan view of the apparatus shown in FIG. 5.
Figure 8:
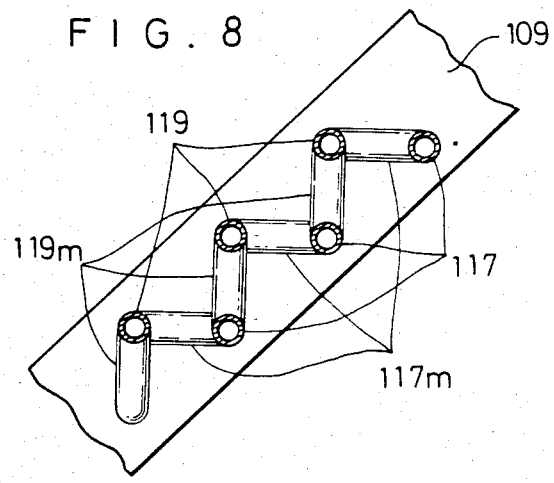
FIG. 8 is a sectional view taken on line 8—8 of FIG. 5.
Figure 9:
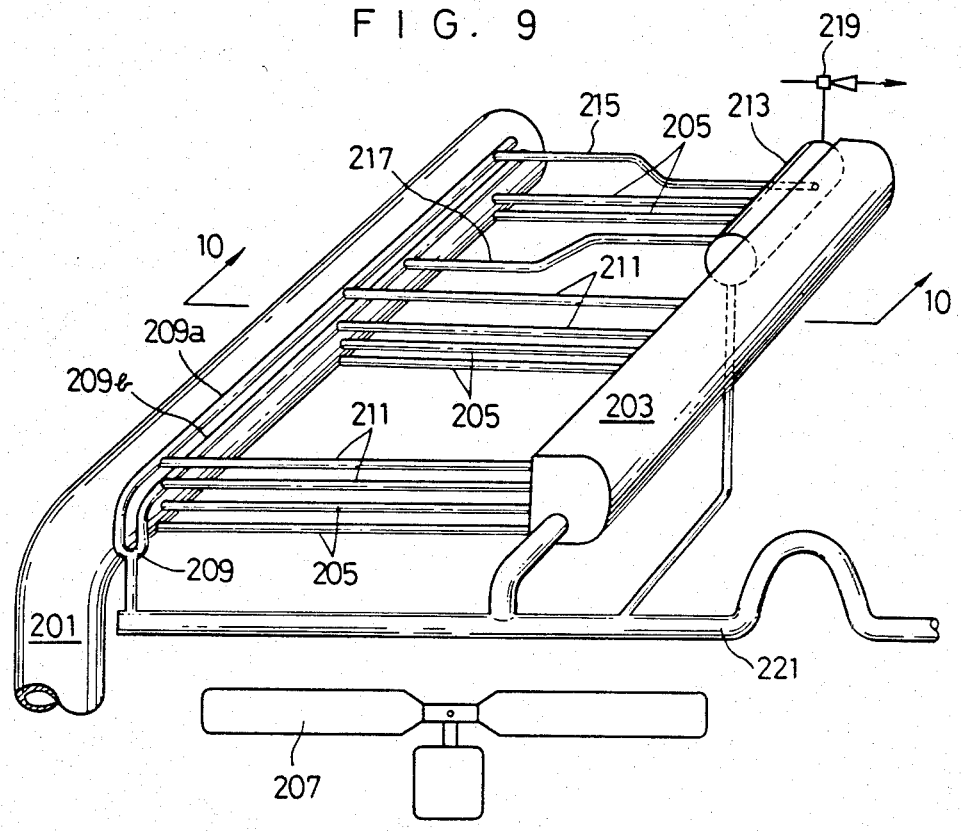
FIG. 9 is a perspective view of apparatus according to a fourth embodiment of the invention.
Figure 10:
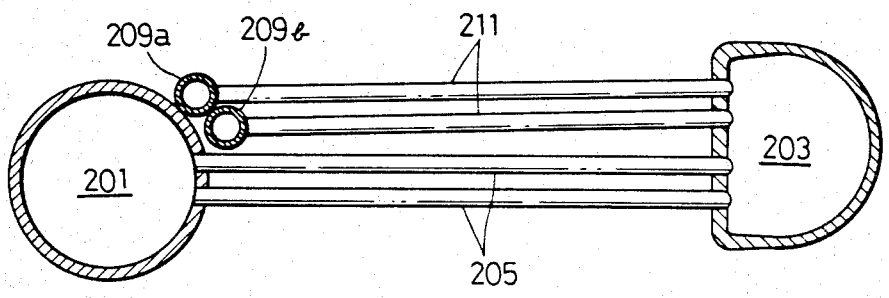
FIG. 10 is an enlarged sectional view taken on line 10—10 of FIG. 9.

The bundle 111 includes a finned tube 117 having one end connected with each lower hole 113*b* in the inlet header 107. These tubes 117 first extend horizontally toward the outlet header 109 (see FIG. 6) before being bent at its middle section 117*m* in a horizontal direction toward the left as seen in FIG. 8 or downwardly as seen in FIG. 6, and then they again extend horizontally toward the outlet header 109 and are connected at their other ends with the associated upper row of holes 115*a*.

The bundle 111 also includes another finned tube 119 having one end connected with each upper hole 113*a* in the inlet header 107. Each tube 119 first extends horizontally toward the outlet header 109 before being directed downward by a bend at its middle section 119*m*, the bend being in a vertical plane passing through the tube 119. Each tube then again extends horizontally toward the outlet header and has its other end connected with the associated lower hole 115*b* of the outlet header.

Thus, each tube of the group of tubes 117 has a longitudinal portion adjacent the inlet header 107 and another longitudinal portion adjacent the outlet header 109 and downstream of the first longitudinal portion, with respect to the air flow. The portion adjacent the header 107 is upstream of the portion adjacent the header 109 because the cooling air flows through the tubes nearly perpendicularly to the plane of the headers, as is shown by FIG. 4. Each tube of the other group of tubes 119 has a longitudinal portion adjacent to the inlet header and downstream of the adjacent longitudinal portion of the first group of tubes 117 with respect to the air flow, and another longitudinal portion adjacent the outlet header and upstream of the opposite portion thereof and the adjacent portion(s) of the first group of tubes 117 with respect to the air flow.

In addition, each tube has no portion that rises in the direction of the fluid flowing therethrough.

The angle A (FIGS. 4 and 5) of the headers relative to the horizon and/or the directions of the middle portions 117*m*, 119*m* of the tubes 117, 119 may otherwise be selected so that drain liquid does not remain within the tubes and so that the tubes do not contact one another.

The outlet header 109 may be provided with a condensate outlet and vent tubes (not shown) similar to those of FIG. 1.

FIGS. 9–12 show the fourth embodiment of the invention as applied to the vent condenser tubes of an air-cooled vapor condenser, which comprises an inlet header 201 and an outlet header 203 each extending in parallel to the other and positioned at an angle of A degrees relative to a horizontal plane. Main condenser tubes 205, only some of which are shown, extend horizontally between the headers 201 and 203 in upper and lower planes over a cooling air fan 207. Another outlet header 209 includes two pipes 209*a* and 209*b* which extend adjacent and along the inlet header 201. A bundle of secondary condenser tubes 211, only some of which are shown, extend horizontally in upper and lower planes over the main tubes 205. A further or final header 213 extends adjacent and along the first outlet header 203.

Figure 11:
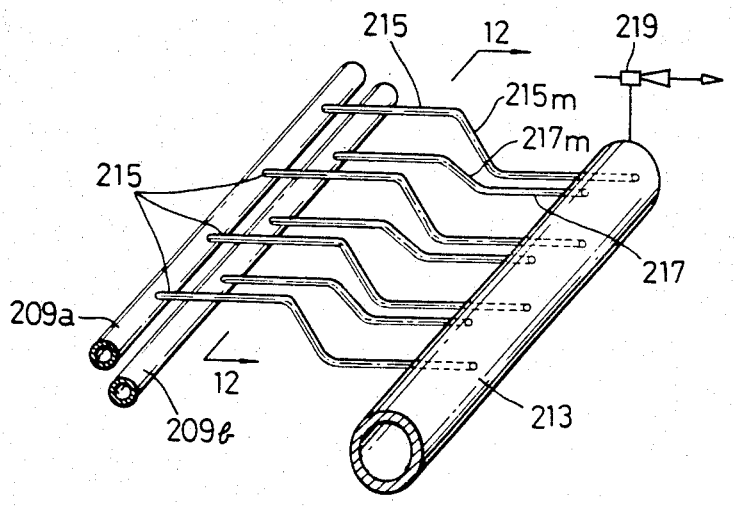
FIG. 11 is a perspective view of a vent condenser of the apparatus shown in FIG. 9.
Figure 12:
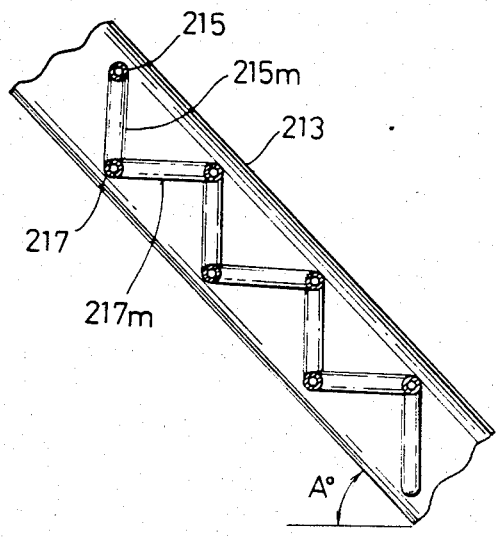
FIG. 12 is a sectional view taken on line 12—12 of FIG. 11.

As best shown in FIG. 11, a plurality of vent condenser tubes 215 extend generally horizontally between the upper pipe 209*a* of the second outlet header and the final header 213. Each tube 215 has a longitudinal portion adjacent the second outlet header 209*a* and another horizontal portion adjacent the final header 213 and upstream of the first longitudinal portion, with respect to the air flow. The two longitudinal portions of each tube 215 are connected by an intermediate bend 215*m* (FIG. 11) which extends in the vertical plane passing through the tube.

Another set of vent condenser tubes 217 extend horizontally between the lower pipe 209*b* of the second outlet header and the final header 213. Each tube 217 has a longitudinal portion adjacent the second outlet header 209 and upstream of the adjacent longitudinal portions of the tubes 215, with respect to the air flow, and another longitudinal portion adjacent the final header 213 and downstream of the first horizontal portion thereof and the adjacent horizontal portions of the tubes 215, the two portions being connected by an intermediate horizontal bent portion 217*m*.

The headers should be at an angle to the horizontal, and the intermediate bends of the vent condenser tubes 215 and 217 should be arranged so as to avoid rising portions in the tubes with respect to the fluid flow therethrough, in order to make the drain liquid easily flow out of the tubes.

Thus, gas exhausted from a turbine flows through the inlet header 201, main tubes 205 and to the first outlet header 203, turns into the secondary tubes 211, into the second outlet header 209, to the vent consenser tubes 215 and 217, and to the final header 213. Non-condensible gases are released from an extractor 219 to the atmosphere. The condensate is removed through a pipe 221 and it may be recirculated to a boiler (not shown).

A major portion of the vapor in the gas is condensed within the main condenser tubes 205 which are cooled the most, and a large amount of drain liquid at approximately the saturation temperature of the vapor is immediately removed from the outlet header 203. This prevents the main tubes from being overcooled and enables smooth recirculation of the drain liquid to a boiler or the like. The quick removal of drain liquid reduces pressure losses of the vapor within the tubes, it enables a predetermined volume of vapor to be easily maintained, and it serves to make the apparatus compact.

The auxiliary condenser tubes 211 and the vent condenser tubes 215 and 217 are located downstream of the main condenser tubes 205 with respect to the air flow so as to be exposed to the air heated by the main condenser tubes. Thereby the vapor is not overcooled and the drain liquid is not frozen within the tubes 211, 215 and 217.

These three-turn bundles of condenser tubes cause the fluid within the vent condenser tubes 215 and 217 to be mostly non-condensible gases and little or no vapor. This fact enables the necessary gas extractor to be small in size.

The main and/or auxiliary condenser tubes 205, 211 may also be designed and arranged like the vent condenser tubes 215 and 217, each having upstream and downstream portions with respect the air flow.

The tubes of the embodiment of FIGS. 9 to 12 are preferably provided with fins (not shown to simplify the drawings), similar to the finned tubes shown in FIGS. 1 and 2.

What is claimed is:

1. An air-cooled heat exchanger comprising at least one set of first tubes and second tubes extending generally in parallel to each other through which fluid being cooled flows in the same direction and across which air flows to cool the fluid within said tubes, said first tubes having a first longitudinal portion and a second longitudinal portion downstream of said first portion with respect to the air flow, and said second tubes having a first longitudinal portion adjacent to and downstream with respect to the air flow from said first portion of said first tubes and a second longitudinal portion adjacent to said second portion of said first tubes and upstream with repect to the air flow of said first portion of said second tubes and also upstream of said second portion of said first tubes, said first and second portions of said tubes being connected by an intermediate bend, first header means and second header means extending substantially in parallel to each other and at an angle to a horizontal plane, said first and second longitudinal portions of each tube extending horizontally between said header means, said tubes being devoid of rising portions in the direction of the fluid flow therethrough, said intermediate bend of one of said first and second tubes being directed substantially horizontally and said bend of the other tubes being directed substantially in a generally vertical plane adjacent said other tubes.

2. An air-cooled heat exchanger comprising at least one set of first tubes and second tubes extending generally in parallel to each other through which fluid being cooled flows in the same direction and across which air flows to cool the fluid within said tubes, said first tubes having a first longitudinal portion and a second longitudinal portion downstream of said first portion with respect to the air flow, and said second tubes having a first longitudinal portion adjacent to and downstream with respect to the air flow from said first portion of said first tubes and a second lonitudinal portion adjacent to said second portion of said first tubes and upstream with respect to the air flow of said first portion of said second tubes and also upstream of said second portion of said first tubes, said first and second portions of said tubes being connected by an intermediate bend, an inlet header, an intermediate header and a final outlet header all lying substantially in parallel to one another and at an angle to the horizon, a gas extractor communicating with said final outlet header, a bundle of tubes extending between said inlet header and said intermediate header, and said first and second tubes extending between said intermediate header and said final outlet header, said intermediate bend of one of said first and second tubes being directed substantially horizontally and said bend of the other tubes being directed substantially in a generally vertical plane and adjacent said other tubes.

* * * * *